United States Patent [19]

Josefsson

[11] 4,325,751

[45] Apr. 20, 1982

[54] METHOD FOR PRODUCING A STEEL STRIP COMPOSED OF A DUAL-PHASE STEEL

[75] Inventor: Erik A. A. Josefsson, Borlänge, Sweden

[73] Assignee: SSAB Svenskt Stal Aktiebolag, Stockholm, Sweden

[21] Appl. No.: 148,942

[22] Filed: May 12, 1980

[30] Foreign Application Priority Data

May 9, 1979 [SE] Sweden ..... 7904053

[51] Int. Cl.[3] ..... C21D 8/02

[52] U.S. Cl. ..... 148/12 F; 148/12.4; 148/36; 148/156

[58] Field of Search ..... 148/12 F, 12 C, 12 D, 148/12.1, 12.3, 12.4, 36, 153, 156

[56] References Cited

U.S. PATENT DOCUMENTS

| | | | |
|---|---|---|---|
| 4,008,103 | 2/1977 | Miyoshi et al. | 148/12 F |
| 4,072,543 | 2/1978 | Coldren et al. | 148/36 X |
| 4,129,461 | 12/1978 | Rashid | 148/12 F X |
| 4,159,218 | 6/1979 | Chatfield et al. | 148/12 F |
| 4,184,898 | 1/1980 | Ouchi et al. | 148/36 X |
| 4,196,025 | 4/1980 | Davies | 148/12 F X |

FOREIGN PATENT DOCUMENTS

| | | | |
|---|---|---|---|
| 54-100920 | 8/1979 | Japan | 148/12 F |
| 54-114426 | 9/1979 | Japan | 148/12 F |
| 197709 | 9/1977 | U.S.S.R. | 148/12 F |

*Primary Examiner*—Peter K. Skiff

*Attorney, Agent, or Firm*—Watson, Cole, Grindle & Watson

[57] ABSTRACT

A steel strip displaying high strength and formability properties is fabricated by coiling a steel strip which has been previously processed through a hot-strip mill from an initial steel having a very low amount of alloying compounds and having a temperature of between 750° and 900° C., the coiled steel strip being maintained at a temperature of between 800° and 650° C. for a period of at least one minute, and thereafter cooled to a temperature of below 450° C., the cooling being accomplished at a rate exceeding 10° C./second.

6 Claims, 2 Drawing Figures

METHOD FOR PRODUCING A STEEL STRIP COMPOSED OF A DUAL-PHASE STEEL

BACKGROUND OF THE INVENTION

1. Field of the Invention

The present invention relates to a method of fabricating a steel strip which will display high strength and formability properties, the initial steel used in forming the steel strip having a low carbon content and including very low amounts of alloying compounds.

2. The Prior Art

In order to produce steels for applications where high strength as well as good formability are required, the so-called dual-phase steels have been developed which are characterized by having a micro-structure of fine-grained, polygonal ferrite with grains of martensite dispersed therein. The strength of such steels is determined mainly by the volume fraction of martensite, whereas the ductility is determined by the volume fraction of ferrite. Thus, as the amount of martensite increases from 5 to 25%, the tensile strength of the steel will vary between approximately 400 and 1,400 MPa, and the elongation thereof will vary between 40 and about 10%.

To develop this internal structure in the steel in a steel strip, an annealing treatment can be utilized which involves heating the steel strip to a temperature above the transformation point $A_1$ in the iron-carbon diagram (usually to about 750° C.), followed by a quick cooling from this temperature (such a quick cooling being achieved, for example, by spraying the steel strip with water or blowing a cooling gas against it). However, such an annealing treatment involves considerable costs, i.e., since such treatment requires the use of much energy and presupposes the use of technically complicated equipment.

One way to avoid these extra costs is to use as the initial steel a steel having suitable alloying compounds therein such that with a suitably elaborated cooling of the hot-rolled steel strip, the desired internal structure will be obtained directly. Such a method is described in U.S. Pat. No. 4,072,543. The advantage of this method is that no heat treatment of the steel strip is needed after the rolling thereof; however, this technique is expensive since the initial steel must include fairly expensive alloying materials, such as molybdenum in amounts of up to 0.4%. In addition, a powerful cooling means must be located downstream of the hot-strip mill, which will be both expensive and troublesome since modern hot-strip mills operate with a high rolling velocity.

It is thus an object of the present invention to provide a method of fabricating a steel strip which will be composed of a dual-phase steel having a high strength and formability, but which will avoid the need to use expensive initial steels and/or expensive and troublesome processing steps required in prior art steel strip fabricating techniques.

SUMMARY OF THE PRESENT INVENTION

It has now been discovered that a steel strip composed of a very good dual-phase steel with good strength and formability properties can be obtained by first coiling the hot-strip steel strip obtained from the hot-rolling step (the coiling possibly being preceded by a certain primary cooling step) and thereafter cooling the steel strip down according to a pre-set cooling scheme. This method is applicable for initial steels having approximately the following composition:

| | |
|---|---|
| C | 0.05–0.20% |
| Si | 0.50–2.0% |
| Mn | 0.50–1.5% |
| Cr | 0–1.5% |
| V | 0–0.15% |
| Mo | 0–0.15% |
| Ti | 0–0.04% |
| Nb | 0–0.02% |
| Fe | balance (the steel also having normal impurities) |

The particular carbon content of the steel is chosen according to the desired tensile strength, whereas the content of silicon, manganese and chromium is chosen according to the thickness of the rolled products. In this latter regard, the thicker the product, the higher the content of these latter elements that is required. The lower values are approximately valid for 1.5 mm steel strips, the higher for 8 mm steel strips.

One or more of the elements vanadium, molybdenum, titanium and niobium can be used to obtain fine-grained austenite after the hot-rolling step and thus also fine-grained ferrite. This can be specially desired for thicker steel strips (thicknesses of over 5 mm).

As is customary, the formability of the steel in the transverse direction can be improved by reducing the amount of elongated sulphide inclusions, either by the addition of misch-metal (REM-treatment), by the addition of small amounts of tellurium, or by keeping the sulphur content well below 0.010%.

The present invention will be better understood by reference to the following discussion taken in conjunction with the accompanying drawings.

DETAILED DESCRIPTION OF THE PREFERRED EMBODIMENTS

Figure 1:
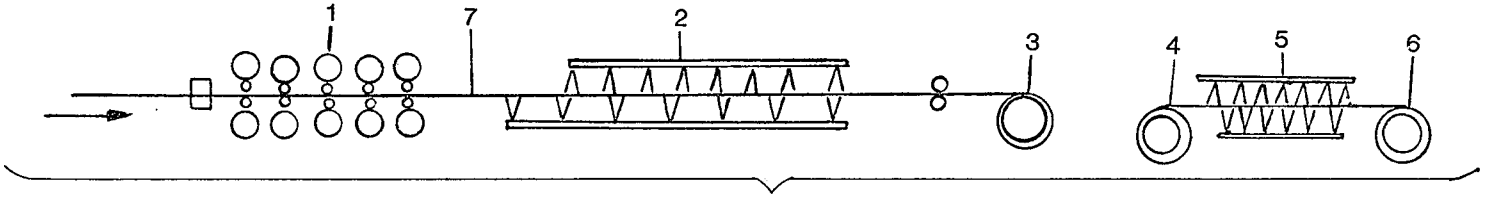
FIG. 1 schematically shows the processing stations required in fabricating a steel strip in accordance with the present invention.

In FIG. 1, a continuous hot strip mill 1 is employed to form an initial steel bar into finished steel strips 7 in a conventional manner. In the hot strip mill 1 the heating temperature and other parameters are adjusted so that the finishing temperature of the hot strip coming from mill 1 is between 750° and 900° C. Normally it is desirable to keep the finishing temperature in the lower part of this range, but higher strip thicknesses and other factors may make it necessary to utilize higher finishing temperatures.

Figure 2:
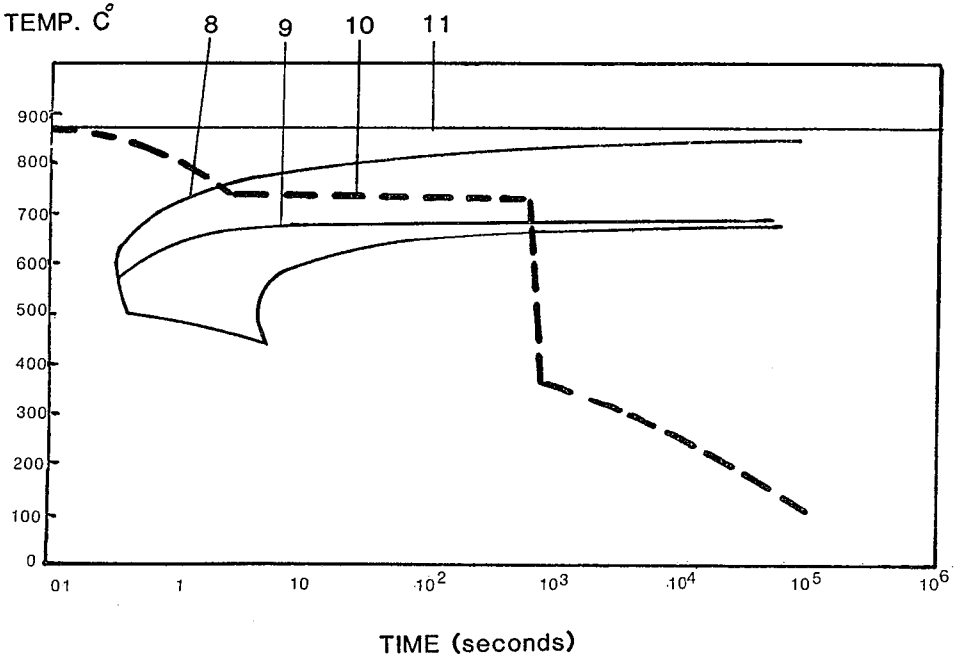
FIG. 2 shows a CCT-diagram for the group of steels treated in accordance with the present invention, the diagram including thereon a cooling sequence conducted in accordance with the present invention.

The steel strip 7 then passes through a first cooling station 2 and is then coiled on a first coiler 3. In the cooling station 2 the temperature of the strip 7 is slightly lowered. After coiling the temperature of the strip 7 will be between 800° and 650° C., preferably between 750° and 650° C. The noted temperature range is optimal for the steel structure with regard to desired strength. "Optimal" in this connection means most favorable for the precipitation of fine-grained ferrite from austenite. The coiled steel strip is maintained within the noted temperature range for at least one minute, and at least long enough that at least 80% of the ferrite normally formed during slow cooling through $A_1$ (see FIG. 2) has precipitated. With reference to FIG. 2, this precipitation takes place below the ferrite transformation curve 8; at the same time it must be above the level of the pearlite transformation curve 9 where the residual austenite begins to transform into pearlite. The curve labeled 10 in the CCT-diagram of FIG. 2 shows an exemplary cooling scheme.

When the whole length of the steel strip thus has been coiled on the first coiler 3 at the predetermined temperature, the coil is transferred to a transport device, roller conveyor, wagon, etc., for subsequent forwarding to a recoiler 4. During this transport the coil is covered with a heat insulating envelope, which envelope will minimize the heat losses and, more importantly, counteract local cooling of the outer parts of the strip 7. To the transport time is added the delay-time required to allow the desired amount of ferrite to form, as discussed above.

When coiling off from the recoiler 4 the strip is led through a second cooling device 5 and thereafter coiled on the second coiler 6. The cooling in the cooling device is so adjusted to the strip velocity that the strip, when it runs up on the second coiler 6, will have a temperature of between 450° and 300° C. The lower temperatures are utilized for steels having low contents of alloying elements, especially silicon, and the higher temperatures for steels with higher contents of such elements. The cooling will be rapid, e.g., at a rate exceeding 10° C./second, such that the transformation of austenite to pearlite and bainite is suppressed, particularly that to upper bainite. Preferably cooling should be rapid enough that at most 5% of the austenite remaining in the steel at the beginning of the cooling will be transformed to pearlite. The austenite should instead be transformed at a lower temperature to martensite. Smaller amounts of low-temperature bainite can also be accepted without adversely affecting the properties of the material.

A slow cooling in the coil after recoiling on the second coiler 6 is favorable in order to attain a low yield point, since it allows the carbon dissolved in the ferrite to precipitate as coarser particles. If, however, a precipitation-hardenable material is desired, the cooling can be accomplished to a lower temperature (below, e.g., 100° C.) before the strip is coiled on the second coiler 6. The steel can then, after forming, be given an increased yield point by precipitation hardening of the carbon retained in supersaturated solution in the ferrite during a tempering treatment at about 200° C.

In the above description the temperature ranges by coiling on the first coiler 3 are set to 800°–650° C., and preferably 750°–650° C. These temperature ranges are dependent on several needs:

(a) The ferrite should be precipitated in the finest dispersion possible since the fine-grain structure contributes to high strength as well as high ductility. This is favored by a high supersaturation at the transformation, i.e., after the finishing rolling the steel strip should be cooled down as quickly as possible to a point sufficiently below the transformation temperature $A_3$ (see the line 11 in FIG. 2) to start a transformation with a high nucleation rate. The temperature should on the other hand not be so low that the main part of the ferrite does not have time to precipitate in the equiaxed (polygonal) form before the next cooling step.

To obtain the intended ductility the amount of ferrite precipitated in this way in polygonal form must constitute at least 80% of the amount of proeutectoid ferrite precipitated from the same steel by slow continuous cooling from the austenite range (e.g. in the furnace), counted as surface percent in a metallographic section. Practically speaking, this means that the coiling temperature must be so much below the transformation temperature $A_3$ for the steel in question that the range for ferrite precipitation in the CCT-diagram valid for the steel is reached fairly quickly, as exemplified in FIG. 2. In this regard, an upper limit can be set at a temperature 100° C. below the transformation temperature $A_3$. For the steel according to FIG. 2, $A_3$ can be set at about 870° C.

(b) The lower limit of the temperature range is determined by the requirement that the austenite shall not to any considerable extent start transforming into pearlite. In steels actually used for the present method (the compositions of which are specified above), the formation of pearlite is displaced towards lower temperatures and longer times in relation to the formation of ferrite. With regard to this, the lower limit is set at $A_1$ minus 50° C., i.e., in this case about 670° C.

A more exact determination of the optimal temperature interval for a certain steel during its transferring from coiler 3 to coiler 4 can thus be achieved by determining the transformation characteristics for the steel in a CCT-diagram, foremost the ferrite transformation curve 8 and the pearlite transformation curve 9, through heat-treatment on a laboratory-scale. The temperature where the remaining austenite is substantially transformed into pearlite is then valid as the lower limit for the range within which the coiling and cooling from the coiler 4 must take place.

EXAMPLE 1

A test which showed that with the method of the present invention a steel strip having very good strength properties could be obtained, even when the steel had very low amounts of alloying elements, was conducted as follows.

| | |
|---|---|
| C | 0.15% |
| Si | 0.91% |
| Mn | 0.63% |
| N | 0.006% |
| Al | 0.03% |
| Fe | balance (and included normal impurities) |

The steel was rolled to a 10 mm thickness. In a laboratory scale analysis, suitable specimens of this material were treated as follows:

1. Heated to 900° C.
2. Quickly transferred to a salt bath furnace at 725° C. and held there for 10 minutes.
3. Transferred to another salt bath furnace at 350° C. and held there for a further 10 minutes.
4. Thereafter allowed to cool in air.

The following mechanical properties were obtained:

| | | |
|---|---|---|
| Yield point | $R_3$ | 412 MPa |
| Tensile strength | $R_m$ | 574 MPa |

-continued

| | | |
|---|---|---|
| Elongation | $A_5$ | 34% |

This combination of high tensile strength and high elongation is characteristic for dual-phase steels.

EXAMPLE 2

Experimental steel ingots were hot-rolled from a thickness of 120 mm down to 160 mm wide strips with a final thickness of 3 mm. The finishing temperature was around 850° C. The strips were directly cooled with water sprays to a (simulated) coiling temperature $T_c$ which varied from 765° to 725° C. depending upon the composition of the particular steel, and were thereafter kept in a furnace held at the temperature $T_c$ for various periods of times, then again cooled with water sprays to below 400° C. and finally cooled in air. Tensile tests were conducted on the strips and values for proportionality limit $R_{0.2\%}$, yield stress at 2% strain $R_{2\%}$, fracture stress $R_m$ and elongation $A_5$ determined. The results are shown in the following table:

| Material | Analysis | | | | Coiling temp. $T_c$ | Holding Time | Mechanical prop. | | | |
|---|---|---|---|---|---|---|---|---|---|---|
| Code | % C | % Si | % Mn | % Cr | °C. | min. | $R_{.2}$ MPa | $R_{2.0}$ MPa | $R_m$ MPa | $A_5$ % |
| 42 B N | .08 | .85 | .90 | .93 | 750 | 5 | 311 | 454 | 616 | 29 |
| 43 A D | .08 | .93 | 1.32 | .51 | 725 | 10 | 361 | 501 | 655 | 26 |
| 43 B A | .08 | 1.22 | 1.29 | .51 | 725 | 5 | 321 | 466 | 660 | 26 |
| 42 A H | .08 | .87 | .87 | .93 | 765 | 10 | 306 | 442 | 623 | 28 |

In all cases the stress strain curve was rounded and showed no sign of yield point elongation. It may be noted that the increase in yield strength for the first two % of plastic strain is around 140 MPa for all four materials.

Although certain preferred embodiments of the present invention have been described above, it will be obvious that various modifications to the method could be utilized and still fall within the scope of the invention as defined in the appended claims.

I claim:

1. A method of forming a steel strip which displays high strength and formability properties, the steel in said steel strip comprising a dual-phase steel containing mostly fine-grained ferrite with grains of martensite dispersed therein, which method comprises (a) processing an initial steel which comprises 0.05–0.20% carbon, 0.50–2.0% silicon, 0.50–1.5% manganese, 0–1.5% chromium, 0–0.15% vanadium, 0–0.15% molybdenum, 0–0.04% titanium, 0–0.02% niobium, balance of iron and normal impurities through a hot-strip mill so as to form a hot steel strip, (b) cooling the hot steel strip of step (a) to a temperature of between 800° and 650° C., (c) coiling the steel strip of step (b), (d) maintaining the temperature of the coiled steel strip of step (c) within the range of 800° and 650° C. for a time period of more than one minute, (e) uncoiling the steel strip of step (d), and (f) cooling the steel strip from step (e) to a temperature of below 450° C. at a rate exceeding 10° C./second.

2. A method according to claim 1 wherein the hot steel strip is cooled in step (b) to a temperature of between 750° and 650° C.

3. A method according to claim 1 wherein the steel strip coming out of the hot-strip mill in step (a) has a temperature of between 750° C. and 900° C.

4. A method according to claim 1 wherein the temperature of the steel strip in step (b) is maintained at a temperature of between 800° and 650° C. for a time period sufficient to cause at least 80% of the ferrite in the steel which would normally form during slow cooling to precipitate.

5. A method according to claim 1 wherein the cooling in step (f) is accomplished at a sufficient rate that at most 5% of the amount of austenite remaining in the steel of the coiled steel strip after step (e) is transformed into pearlite.

6. A method according to claim 1 wherein the cooling in step (b) is accomplished while the steel strip passes through a first cooling device, and wherein the cooling in step (f) is accomplished while the steel strip passes through a second cooling device.

* * * * *